US009738091B2

(12) United States Patent
Yoshizawa et al.

(10) Patent No.: US 9,738,091 B2
(45) Date of Patent: Aug. 22, 2017

(54) THERMAL PRINTER

(71) Applicant: SATO HOLDINGS KABUSHIKI KAISHA, Tokyo (JP)

(72) Inventors: Koji Yoshizawa, Tokyo (JP); Masayuki Iioka, Ibaraki (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/021,410

(22) PCT Filed: Sep. 12, 2014

(86) PCT No.: PCT/JP2014/074217

§ 371 (c)(1),
(2) Date: Mar. 11, 2016

(87) PCT Pub. No.: WO2015/037704

PCT Pub. Date: Mar. 19, 2015

(65) Prior Publication Data

US 2016/0221355 A1 Aug. 4, 2016

(30) Foreign Application Priority Data

Sep. 13, 2013 (JP) ..... 2013-190082

(51) Int. Cl.

| | |
|---|---|
| ***B41J 29/393*** | (2006.01) |
| ***B41J 2/355*** | (2006.01) |
| ***B41J 2/375*** | (2006.01) |
| ***B41J 3/407*** | (2006.01) |

(52) U.S. Cl.

CPC ..... *B41J 2/355* (2013.01); *B41J 2/375* (2013.01); *B41J 3/4075* (2013.01)

(58) Field of Classification Search

CPC .... B41J 29/393; B41J 2/17566; B41J 2/0451; B41J 2/195

See application file for complete search history.

(56) References Cited

U.S. PATENT DOCUMENTS 8,905,519 B2 * 12/2014 Silverbrook ..... B41J 2/14 347/42
9,168,755 B2 * 10/2015 Silverbrook ..... B41J 2/14

FOREIGN PATENT DOCUMENTS

| | | | |
|---|---|---|---|
| JP | 11-099683 | A | 4/1999 |
| JP | 11-268386 | A | 10/1999 |
| JP | 2001-038943 | A | 2/2001 |
| JP | 2003-305879 | A | 10/2003 |

(Continued)

*Primary Examiner* — Lamson Nguyen
(74) *Attorney, Agent, or Firm* — Foley & Lardner LLP

(57) ABSTRACT

In order to provide a thermal printer capable of reliably performing an electric disconnection inspection for a heating element in the case of an optical identification code such as a bar code, reducing frequency of the electric disconnection inspection as necessary, and performing the electric disconnection inspection suitably for a use condition, a thermal printer includes: a platen roller that feeds a paper sheet; a thermal head having a plurality of heating elements for printing print data on a print area of the paper sheet fed by the platen roller; and a CPU that serves as an inspection unit that inspects whether or not there is an electric disconnection in the heating element and a control unit that controls operations of the inspection unit. The CPU is configured to change the inspection frequency.

7 Claims, 7 Drawing Sheets

(56) References Cited

FOREIGN PATENT DOCUMENTS

| | | | |
|---|---|---|---|
| JP | 2006-289686 | A | 10/2006 |
| JP | 2009-214456 | A | 9/2009 |

* cited by examiner

THERMAL PRINTER

TECHNICAL FIELD

This invention relates to a thermal printer that performs printing by using a thermal head.

BACKGROUND ART

In a label printer of the prior art, some heating elements of a thermal head suffer from an electric disconnection during feed of a paper sheet (print medium) due to friction between the paper sheet and the thermal head or the like in some cases. This electric disconnection of the heating element disadvantageously generates blurry printing by which a portion corresponding to the heating element suffering from the electric disconnection is not printed. In particular, if the electric disconnection is generated in any one of the heating elements of the thermal head corresponding to a print area of a bar code, the corresponding bar code may not be recognized when a user tries to read the printed bar code.

As discussed in Patent Literature 1, a check (inspection) on whether or not there is an electric disconnection in the heating element is performed, for example, by preparing a detection resistor in parallel with each heating element and measuring a voltage of a check terminal connected to one end thereof. If a minute electric current flows through the heating element, and the heating element has no electric disconnection, most of the electric current flows through the heating element. Therefore, a voltage of the check terminal becomes low. In comparison, if the heating element has an electric disconnection, most of the electric current flows through the detection resistor. Therefore, the voltage of the check terminal becomes high. In this manner, if the heating elements to be diagnosed are supplied with electric currents one by one, and the voltage check is performed by using the check terminal, it is possible to diagnose electric disconnections of the heating elements.

A process of diagnosing the electric disconnection of the heating element is carried out while the thermal head does not perform printing, that is, while the heating element of the thermal head faces a gap between labels.

PRIOR ART DOCUMENT(S)

Patent Literatures

Patent Literature 1: JP 2001-38943 A

SUMMARY OF INVENTION

Problems to be Solved

However, the check for the thermal head is performed while the paper sheet is fed. Therefore, as the thermal heads are large-sized in recent years, the time necessary to perform the check for the thermal head increases. As a result, it is difficult to complete the check for the thermal head while the gap is located directly under the thermal head. That is, in some cases, it may be difficult to perform the check for the electric disconnection for overall heating elements of the thermal head while the heating elements face a part of the gap between labels. For this reason, in the prior art, when the thermal head is checked, the feed speed of the paper sheet is delayed in order to position the thermal head within the gap during the check of the thermal head. However, in this case, the number of printed sheets per unit time is reduced disadvantageously. Furthermore, it is necessary to periodically change the feed speed to be fast during printing and be slow during the check of the thermal head. This burdens the feed motor with a lot of loads disadvantageously.

In the prior art, whether the check of the thermal head is valid or invalid can be selected. Therefore, if the check of the thermal head is set to "invalid," it is possible to efficiently perform printing. However, in this case, the printing may be performed while the heating element is electrically disconnected, so that the bar code may be erroneously read.

In view of the aforementioned problems, it is therefore an object of the present invention to provide a thermal printer capable of reliably performing an electric disconnection inspection for a heating element in the case of an optical identification code such as a bar code, reducing frequency of the electric disconnection inspection as necessary, and performing the electric disconnection inspection suitably for a use condition.

Means for Solving the Problems

According to this invention, the aforementioned problems are addressed by the following solving means.

According to an aspect of this invention, there is disclosed a thermal printer including: a feed unit that feeds a print medium; a thermal head having a plurality of heating elements for printing print data on a print area of the print medium fed by the feed unit; an inspection unit that inspects whether or not there is an electric disconnection in the heating elements; and a control unit that controls an operation of the inspection unit, wherein the control unit is configured to change inspection frequency of the inspection unit.

In the thermal printer described above, the control unit may receive the input inspection frequency and cause the inspection unit to perform the inspection on the basis of the input inspection frequency.

In the thermal printer described above, the control unit automatically changes the inspection frequency depending on contents of the print data.

In the thermal printer described above, the control unit may increase the inspection frequency when the print data contains an optical identification code, compared to when the print data does not contain the optical identification code.

In the thermal printer described above, the control unit may reduce the inspection frequency when the print data does not contain an optical identification code, compared to when the print data contains the optical identification code.

The thermal printer described above may further include a communication unit that performs communication with an external device, and the control unit may change the inspection frequency depending on an external instruction input via the communication unit.

In the thermal printer described above, the control unit may cause the inspection unit to perform the inspection when the thermal head does not perform printing and the feed unit performs feeding of the print medium.

Advantageous Effect

Using the thermal printer according to this invention, it is possible to reliably perform an electric disconnection inspection for heating elements in the case of an optical identification code such as a bar code, reduce frequency of the electric disconnection inspection as necessary, and perform the electric disconnection inspection suitably for a use condition.

DESCRIPTION OF EMBODIMENTS

Hereinafter, a description will be made for preferable embodiments of this invention with reference to the accompanying drawings.

First Embodiment

Figure 1:
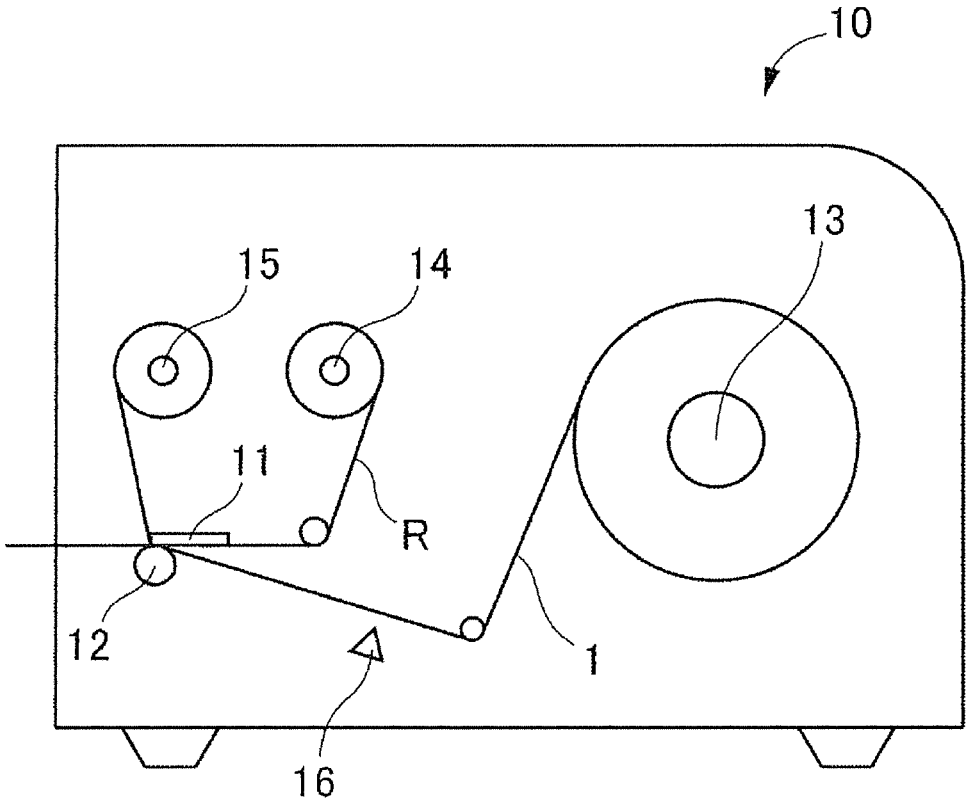
FIG. 1 is a diagram schematically illustrating a thermal printer 10 according to a first embodiment of this invention.

FIG. 1 is a diagram schematically illustrating a thermal printer 10 according to a first embodiment of this invention. It is noted that each drawing including FIG. 1 is schematically illustrated, and sizes and configurations of each part may be exaggerated suitably for easy understanding. In the following description, although dimensions, shapes, and materials will be described specifically, they are just for illustrative purposes and may change appropriately.

The thermal printer 10 is a label printer having a thermal head 11, a platen roller 12, a label feeding unit 13, a ribbon feeding unit 14, a ribbon winding unit 15, and a sensor 16.

The thermal head 11 includes a plurality of heating elements arranged side by side along a width direction and is disposed to face the platen roller 12. The heating elements abut to a paper sheet 1 descried below while the paper sheet 1 is nipped between the heating elements and the platen roller 12. In addition, the thermal head 11 is pressed toward the platen roller 12. The thermal head 11 transfers ink from the ink ribbon R to the paper sheet 1 by selectively heating the heating elements to perform printing. Alternatively, the thermal head 11 may perform printing for a thermal paper sheet.

Figure 3:
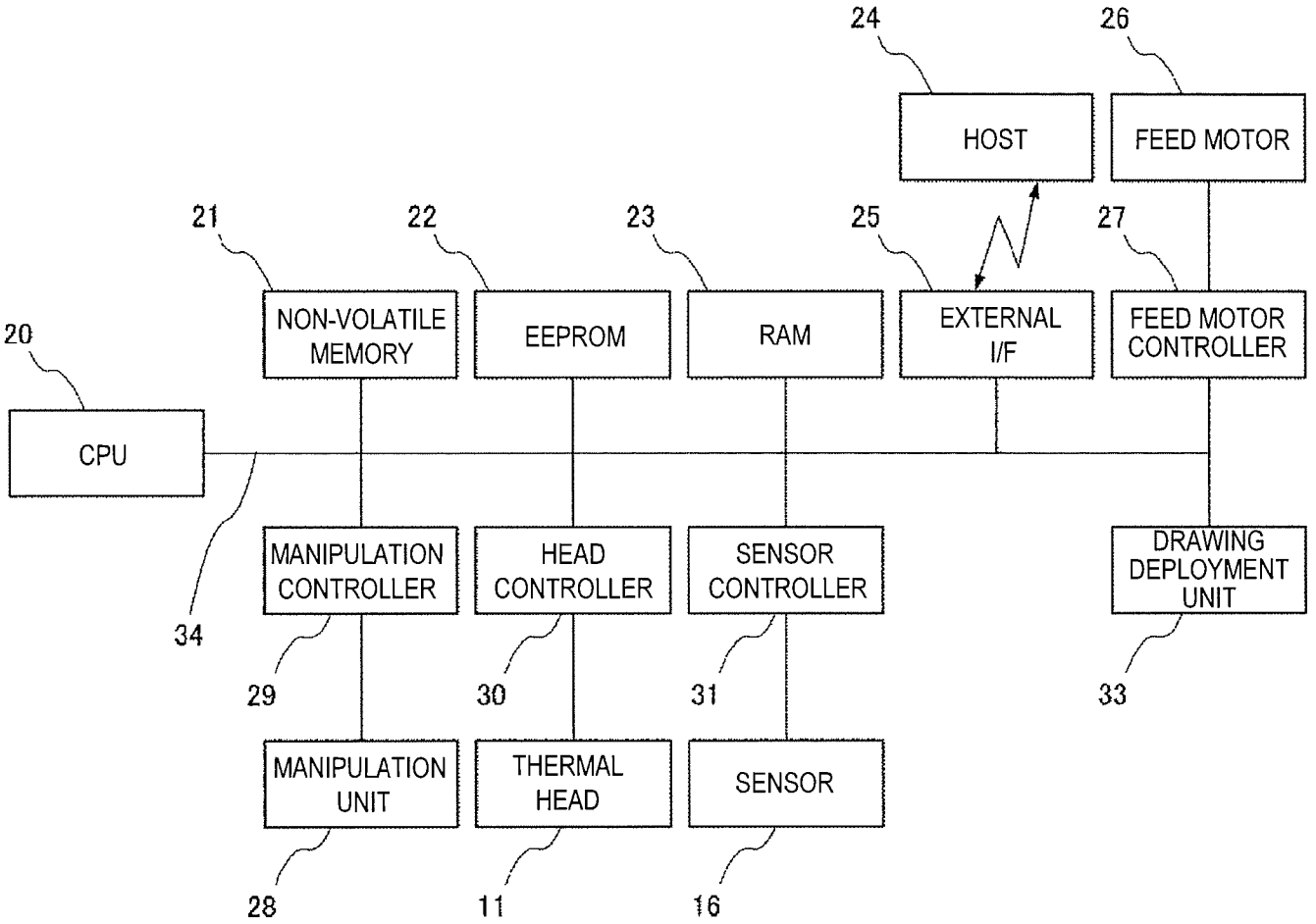
FIG. 3 is a schematic block diagram illustrating a circuit configuration of the thermal printer 10.

The platen roller (feed unit) 12 is connected to a feed motor 26 by using a timing belt (not illustrated) (refer to FIG. 3). The platen roller 12 is rotatably driven by the feed motor 26.

The paper sheet 1 wound in a roll-like manner is loaded on the label feeding unit 13, which continuously feeds the paper sheet 1 to the gap between the thermal head 11 and the platen roller 12.

The ribbon feeding unit 14 feeds the ink ribbon R into the gap between the thermal head 11 and the platen roller 12 for performing heat transfer printing for a label 3 (refer to FIGS. 2A and 2B) on the paper sheet 1.

The ribbon winding unit 15 winds out the used ink ribbon R from the gap between the thermal head 11 and the platen roller 12 to recover the used ink ribbon R.

The sensor 16 is an optical sensor arranged in the middle of the feed passage of the paper sheet 1 to sense a leading edge of the label 3.

Figure 2A:
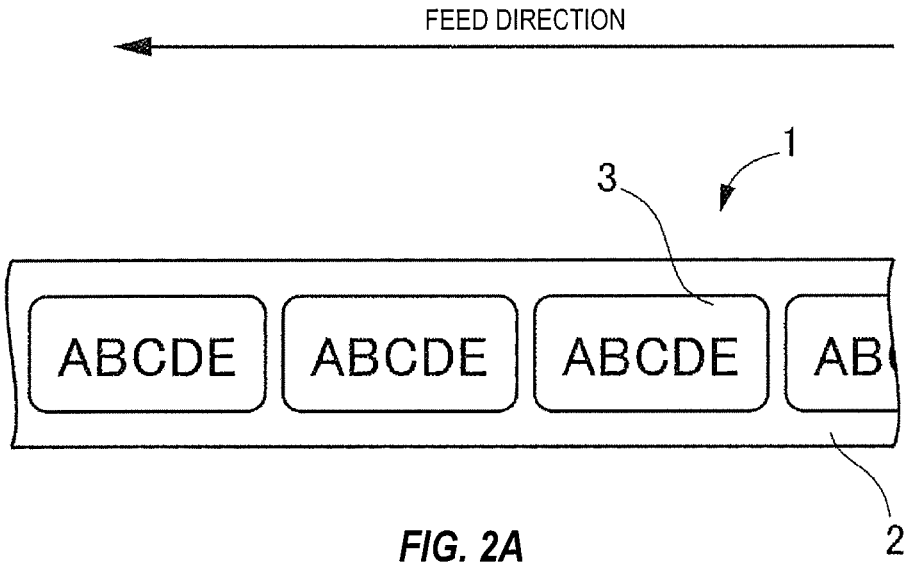
FIGS. 2A and 2B are diagrams schematically illustrating a paper sheet 1 subjected to printing.
Figure 2B:
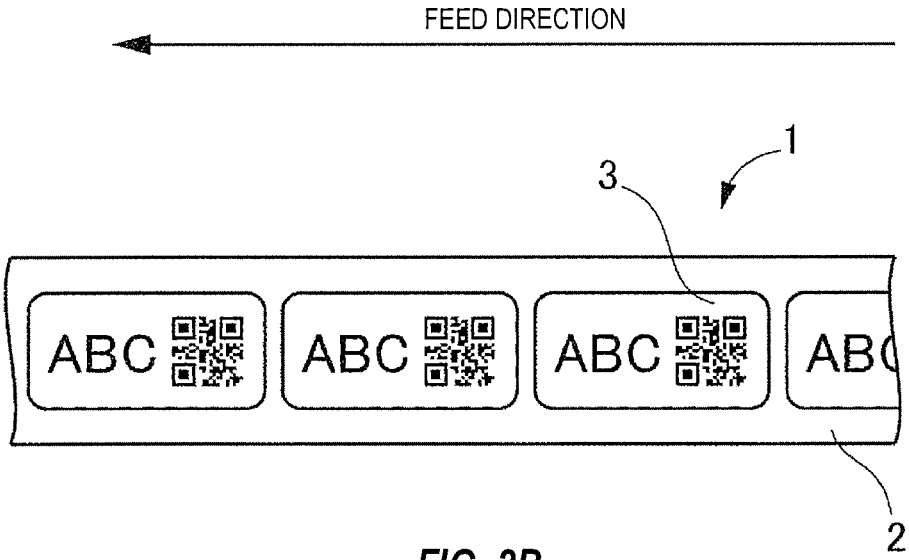

FIGS. 2A and 2B are diagrams schematically illustrating paper sheets 1 subjected to the printing. FIG. 2A illustrates the paper sheet 1 having only text, and FIG. 2B illustrates the paper sheet 1 having text and two-dimensional codes. The paper sheet (print medium) 1 includes a liner sheet 2 and a label 3. It is noted that the paper sheet 1 is not limited to those formed of paper, but may partially or wholly be formed of a resin material. The liner sheet 2 is formed in a band-like shape, and one surface thereof serves as a stripping surface. The label 3 is temporarily attached to the stripping surface of the liner sheet 2 by using an adhesive layer (not illustrated).

FIG. 3 is a schematic block diagram illustrating a circuit configuration of the thermal printer 10. The thermal printer 10 has a CPU 20, a non-volatile memory 21, an EEPROM 22, a RAM 23, an external interface 25, a feed motor 26, a feed motor controller 27, a manipulation unit 28, a manipulation controller 29, a head controller 30, a sensor controller 31, a drawing deployment unit 33, and a system bus 34.

The CPU (central processing unit) 20 is operated based on various control programs stored in the non-volatile memory 21 to generally control each of parts described below via the system bus 34. According to this embodiment, the CPU 20 serves as an inspection unit that inspects whether or not an electric disconnection occurs in the heating element of the thermal head 11 and a control unit that controls the operation of the inspection unit.

The non-volatile memory 21 is a ROM (read only memory), a flash memory, or the like for storing programs of the various controllers. The EEPROM (electrically erasable programmable read-only memory) 22 is a non-volatile programmable memory for storing settings of various operations of the thermal printer 10. The RAM (random access memory) 23 serves as a work area of the CPU 20. The external interface (I/F) 25 is an interface for communication with the host 24 in a wired or wireless manner.

The feed motor 26 is a motor such as a step motor for feeding the paper sheet 1 by driving the platen roller 12. The feed motor controller 27 controls the feed motor 26. The feed motor controller 27 controls the feed speed of the liner sheet 2 having the label 3 temporarily attached by controlling a rotation speed of the feed motor 26. In addition, the feed motor controller 27 controls whether the feed motor 26 is forwardly rotated to feed the liner sheet 2 from the upstream to the downstream in a label feed direction or the feed motor 26 is backwardly rotated to feed the liner sheet 2 from the downstream to the upstream reversely to the label feed direction.

The manipulation unit 28 has various buttons used to input settings for information regarding operations of the thermal printer 10 and a display unit. The manipulation controller 29 controls the manipulation unit 28. The head controller 30 controls the thermal head 11. The sensor controller 31 controls the sensor 16. The drawing deployment unit 33 generates drawings for printing variable information on the surface of the label 3.

Figure 4:
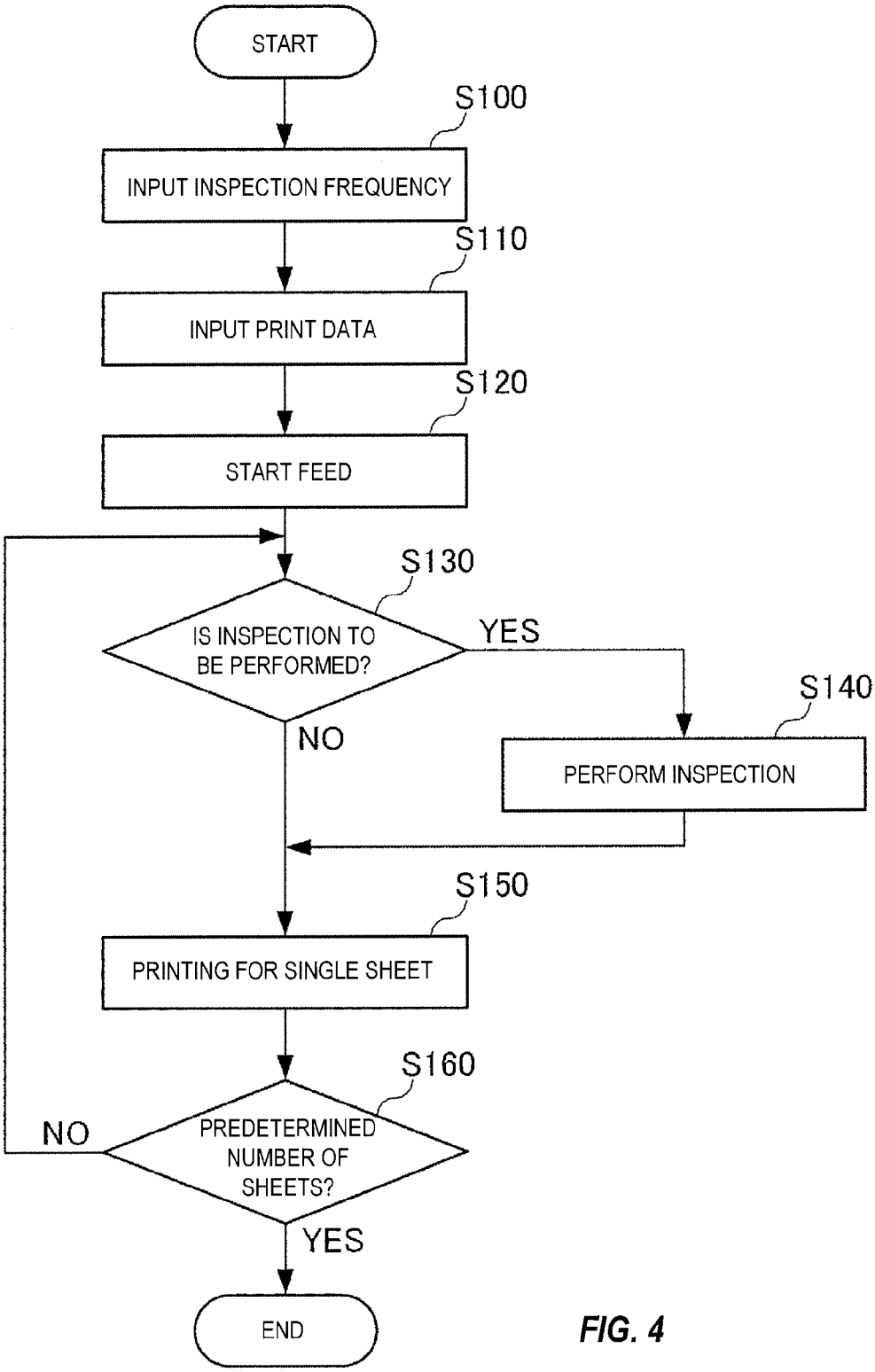
FIG. 4 is a flowchart illustrating an operation flow of an electric disconnection inspection for a heating element of the thermal printer 10 according to the first embodiment.

FIG. 4 is a flowchart illustrating an operation flow of the electric disconnection inspection for the heating element of the thermal printer 10 according to the first embodiment.

In step S100, the CPU 20 receives frequency of the electric disconnection inspection for the heating element, input from a user by using the manipulation unit 28. For example, if the received frequency is set to "inspection interval=two sheets," the check is performed once whenever two sheets of labels 3 are printed. Otherwise, when the inspection interval is set to a specified number of print sheets or more, the electric disconnection inspection is performed only for the first and last sheets. It is noted that, when no inspection interval is input, the electric disconnection inspection is performed for every sheet. Preferably, a user inputs the inspection frequency by changing it to an appropriate value in consideration of balance between a print quality and a print speed. For example, if only the text is printed as illustrated in FIG. 2A, the inspection interval may be set to a large value by prioritizing the print speed. In comparison, if an optical identification code such as a two-dimensional code or a bar code is contained as illustrated in FIG. 2B, the electric disconnection inspection may be performed for every sheet by prioritizing the print quality.

In step S110, the CPU 20 receives, for example, the print data input from the host 24. It is noted that, in the thermal printer 10 according to this embodiment, the printing can be performed even when the host 24 is not connected. In this case, the print data is input, for example, by calling a print format stored in the EEPROM 22 and the like.

In step S120, the CPU 20 issues an instruction to the feed motor controller 27 to start the operation of the platen roller and feed of the paper sheet 1.

In step S130, the CPU 20 determines whether or not the inspection is to be performed. This determination is made based on the inspection frequency input in step S100. If it is determined that the inspection is to be performed, the process advances to step S140. Otherwise, if it is determined that the inspection is not to be performed, the process advances to step S150.

In step S140, the CPU 20 performs the electric disconnection inspection for the heating element. Specifically, the inspection may be performed based on techniques known in the art. According to this embodiment, the inspection is performed by preparing a detection resistor in parallel with each heating element and measuring a voltage of a check terminal connected to one end thereof. When a minute electric current flows to the heating element, and there is no electric disconnection in the heating element, most of the current flows through the heating element, and the voltage of the check terminal becomes low. In comparison, when there is an electric disconnection in the heating element, most of the electric current flows through the detection resistor. Therefore, the voltage of the check terminal becomes high. In this manner, the electric disconnection of the heating element is diagnosed by flowing electric currents to the heating elements to be diagnosed one by one and checking the voltage by using the check terminal. It is noted that the feed of the paper sheet 1 is temporarily halted during the inspection.

In step S150, the print data is printed on a single sheet of the label 3.

In step S160, it is determined whether or not the printing has been completed for a predetermined number of sheets. If it is determined that the printing has been completed, the operation is terminated. Otherwise, if it is determined that the printing has not been completed, the process returns to step S130, and the determination on whether or not the inspection is to be performed is repeated.

As described above, according to the first embodiment, a user can freely set the frequency of the electric disconnection inspection for the heating element. Therefore, by setting the inspection frequency not to be excessive, it is possible to perform the electric disconnection inspection with the inspection frequency suitable for the print data. As a result, using the thermal printer 10 according to the first embodiment, it is possible to efficiently perform the printing and the inspection and improve the print processing speed generally. In addition, using the thermal printer 10, it is possible to reliably perform the electric disconnection inspection for the heating element in the case of an optical identification code such as a bar code. In addition, it is possible to reduce the frequency of the electric disconnection inspection as necessary and perform the electric disconnection inspection suitably for a use condition.

Second Embodiment

Figure 5:
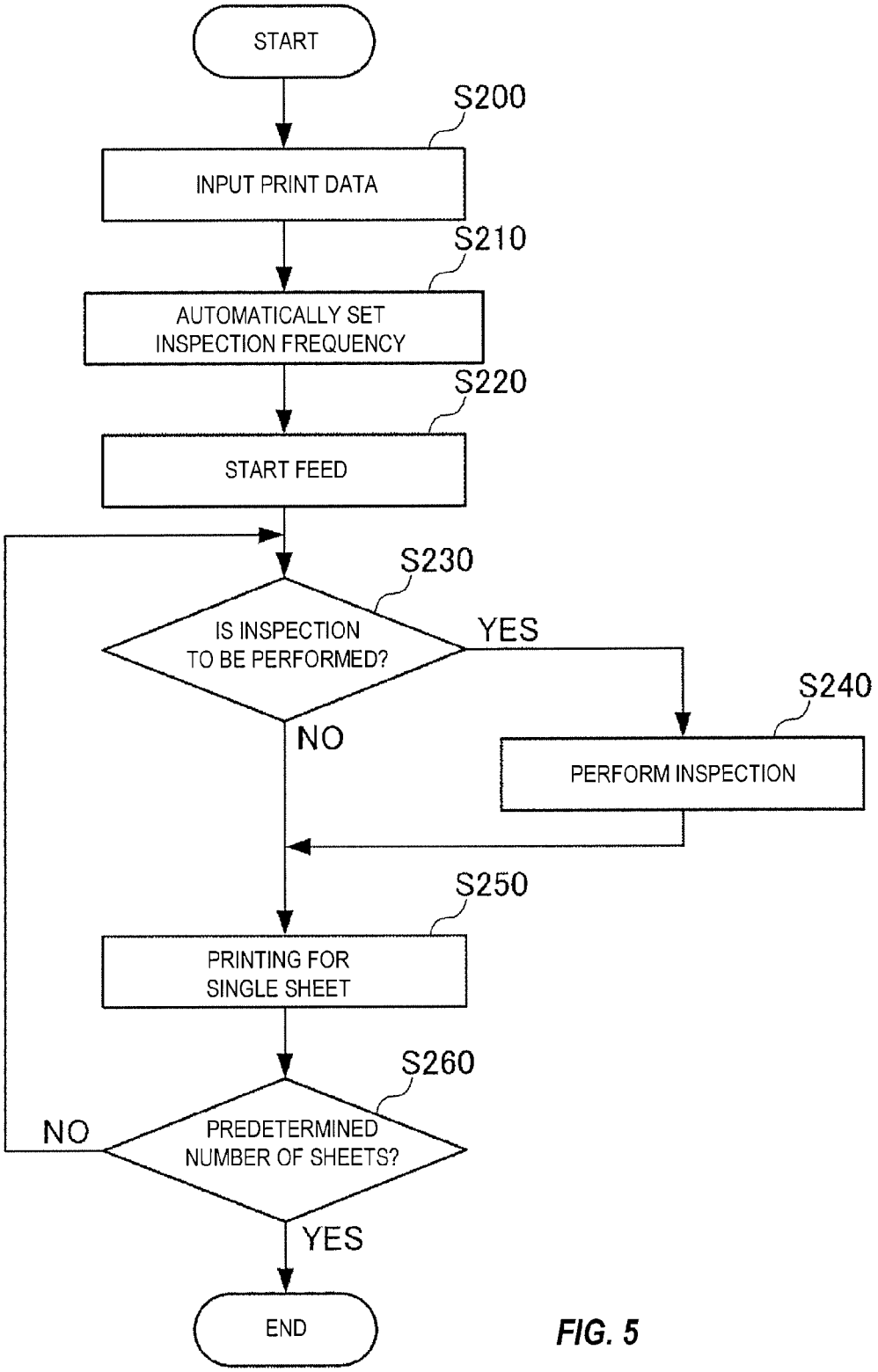
FIG. 5 is a flowchart illustrating an operation flow of an electric disconnection inspection for a heating element of a thermal printer 10 according to a second embodiment.

FIG. 5 is a flowchart illustrating an operation flow of the electric disconnection inspection for the heating element of the thermal printer 10 according to a second embodiment. The thermal printer 10 according to the second embodiment is similar to that of the first embodiment except for the operation of the CPU 20. Therefore, like reference numerals denote like elements as in the first embodiment, and they will not be described in detail.

In step S200, the CPU 20 receives the print data, for example, input from the host 24.

In step S210, the CPU 20 analyzes the contents of the print data and automatically changes the inspection frequency depending on the contents of the print data. For example, if the print data does not contain an optical identification code, the inspection frequency is set to "5." If the print data contains an optical identification code, the CPU 20 changes the inspection frequency to "every single sheet." In this manner, the inspection frequency may be set to be larger when the print data contains an optical identification code, compared to when the print data does not contain the optical identification code. On the contrary, it is noted that a case where the print data contains the optical identification code may serve as a reference. That is, when the print data does not contain an optical identification code, the CPU 20 may reduce the inspection frequency, compared to when the print data contains the optical identification code.

Steps S220 to S260 are similar to steps S120 to S160 of the first embodiment. Therefore, they will not be described in detail.

As described above, according to the second embodiment, the CPU 20 automatically changes the inspection frequency depending on the contents of the print data. Therefore, optimum inspection frequency is set automatically even when a user does not input the inspection frequency. As a result, using the thermal printer 10 according to the second embodiment, it is possible to efficiently perform the printing and the inspection without requiring a user to perform a special manipulation or have a skill and thus improve the print processing speed generally in an automatic manner. In addition, using the thermal printer 10, it is possible to reliably perform the electric disconnection inspection for the heating element in the case of an optical identification code such as a bar code. In addition, it is possible to reduce the frequency of the electric disconnection inspection as necessary and perform the electric disconnection inspection suitably for a use condition.

Third Embodiment

Figure 6:
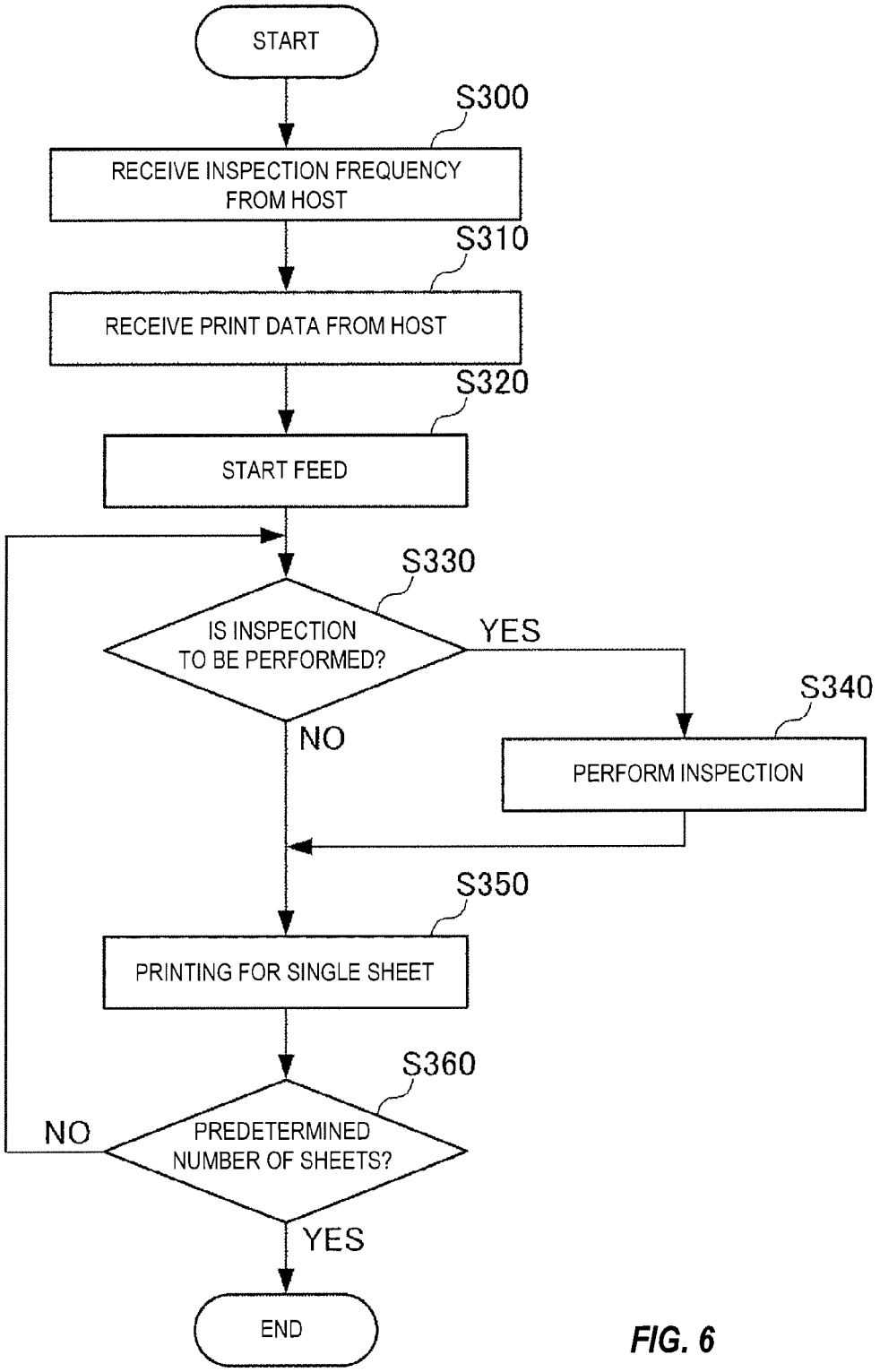
FIG. 6 is a flowchart illustrating an operation flow of an electric disconnection inspection for a heating element of a thermal printer 10 according to a third embodiment.

FIG. 6 is a flowchart illustrating an operation flow of the electric disconnection inspection for the heating element of the thermal printer 10 according to a third embodiment. The thermal printer 10 according to the third embodiment is similar to that of the first embodiment except for the operation of the CPU 20. Therefore, like reference numerals denote like elements as in the first embodiment, and they will not be described in detail.

In step S300, the CPU 20 receives the inspection frequency input from the host 24 (for example, a personal computer). That is, according to the third embodiment, the frequency of the electric disconnection inspection for the heating element may be input from a user in advance by using the host 24 or may be set automatically depending on the print data. In some cases, the manipulation unit 28 of the thermal printer 10 is simplified in order to achieve miniaturization and low cost. Even in this case, it is possible to more simply perform setting of the frequency by using the host 24. In addition, since the print data is input from the host 24 (as described in step S310), it is possible to easily perform automatic setting of the inspection frequency on the basis of the print data.

In step S310, the CPU 20 receives the print data input from the host 24.

Steps S320 to S360 are similar to steps S120 to S160 of the first embodiment, and they will not be described in detail.

As described above, according to the third embodiment, the CPU 20 receives the inspection frequency input from the host 24. Therefore, even when the manipulation unit 28 of the thermal printer 10 has a simple structure, a user can set the inspection frequency simply by using the host 24. In addition, it is possible to allow the host 24 side to automatically set the inspection frequency. Therefore, even when the manipulation unit 28 of the thermal printer 10 according to the third embodiment has a simple structure, it is possible to efficiently perform the printing and the inspection and improve the print processing speed generally in an automatic manner. Furthermore, using the thermal printer 10, it is possible to reliably perform the electric disconnection inspection for the heating element in the case of an optical identification code such as a bar code and reduce the frequency of the electric disconnection inspection as necessary. Furthermore, it is possible to perform the electric disconnection inspection suitably for a use condition.

Fourth Embodiment

Figure 7:
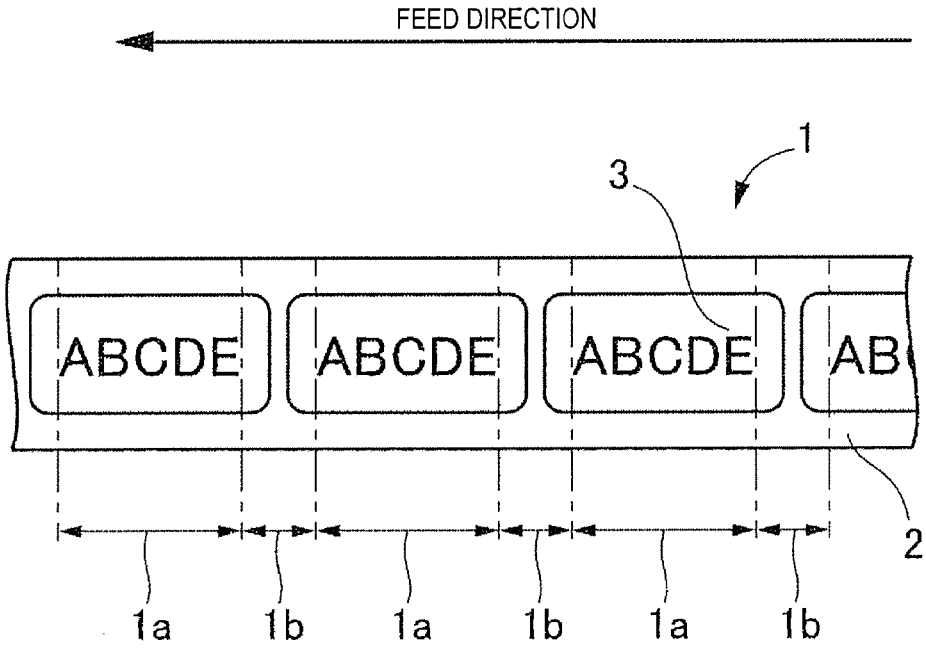
FIG. 7 is a diagram schematically illustrating a paper sheet 1 subjected to printing according to a fourth embodiment.

FIG. 7 is a diagram schematically illustrating a paper sheet 1 subjected to the printing according to a fourth embodiment. The thermal printer 10 according to the fourth embodiment is similar to that of the first embodiment except for the inspection operation of the CPU 20. Therefore, like reference numerals denote like elements as in the first embodiment, and they will not be described in detail.

The CPU 20 according to the fourth embodiment performs the inspection on the basis of the setting of the inspection frequency. However, the inspection timing is set such that the inspection is performed while the thermal head 11 faces a non-print area in the middle of feeding of the paper sheet 1.

Referring to FIG. 7, while the thermal head 11 faces a print area 1*a*, it is, of course, difficult to perform the inspection because the printing process is performed. However, the electric disconnection inspection for the heating element can be performed while the thermal head 11 faces the non-print area 1*b* even in the middle of feeding of the paper sheet 1. Therefore, according to the fourth embodiment, the CPU 20 performs the inspection while the thermal head 11 faces the non-print area in the middle of feeding of the paper sheet 1.

It is noted that, although depending on the non-print area, it may be difficult to terminate the inspection within the non-print area in some cases. In this case, for example, the feed may be halted temporarily while the inspection is performed.

As described above, according to the fourth embodiment, it is possible to partially or wholly perform the electric disconnection inspection in the middle of feeding. Therefore, using the thermal printer 10 according to the fourth embodiment, it is possible to efficiently perform the printing and the inspection and improve the print processing speed generally. In addition, using the thermal printer 10, it is possible to reliably perform the electric disconnection inspection for the heating element in the case of an optical identification code such as a bar code. Furthermore, it is possible to reduce the frequency of the electric disconnection inspection as necessary and perform the electric disconnection inspection suitably for a use condition.

It is noted that, in this specification and the attached claims, the "printing" refers to an output operation for various types of information by using the thermal printer as a typical use example known in the art. The "printing" refers to the output operation of information using the thermal printer as described above. Therefore, the "printing" is not only limited to the output operation of text, but also includes the output operation of figures or images such as bar codes.

Modification

The invention may be changed or modified in various manners without limiting those described above, which will be regarded as being within the scope of the invention.

According to the fourth embodiment, the electric disconnection inspection is performed in the middle of feeding while the inspection frequency is set as described in the first embodiment. However, the invention is not limited thereto. For example, the electric disconnection inspection may be performed in the middle of feeding while the inspection frequency is set as described in the second or third embodiment.

It is noted that the first to fourth embodiments and the modification may be combined appropriately although they will not described specifically herein. In addition, it would be appreciated that the invention may be embodied in various manners without limiting to those described above.

REFERENCE SIGNS AND NUMERALS

1 paper sheet
1*a* print area
1*b* non-print area
2 liner sheet
3 label
5 inspection frequency
10 thermal printer
11 thermal head
12 platen roller
13 label feeding unit
14 ribbon feeding unit
15 ribbon winding unit
16 sensor
20 CPU
21 non-volatile memory
22 ROM
23 RAM
24 host
25 external interface
26 feed motor
27 feed motor controller
28 manipulation unit
29 manipulation controller
30 head controller
31 sensor controller
33 drawing deployment unit
34 system bus

The invention claimed is:

1. A thermal printer comprising:

a feed unit that feeds a print medium;

a thermal head having a plurality of heating elements for printing print data on a print area of the print medium fed by the feed unit;

an inspection unit that inspects whether or not there is an electric disconnection in the heating elements; and a control unit that controls an operation of the inspection unit, wherein the control unit causes the inspection unit to perform the inspection when a predetermined number of labels are printed, and the control unit is configured to change the predetermined number of labels.

2. The thermal printer according to claim 1, wherein the control unit receives an input value of the predetermined number of labels and causes the inspection unit to perform the inspection on the basis of the predetermined number of labels being input.

3. The thermal printer according to claim 1, wherein the control unit automatically changes the predetermined number of labels depending on contents of the print data.

4. The thermal printer according to claim 3, wherein the control unit reduces the predetermined number of labels when the print data contains an optical identification code, compared to when the print data does not contain the optical identification code.

5. The thermal printer according to claim 3, wherein the control unit increases the predetermined number of labels when the print data does not contain an optical identification code, compared to when the print data contains the optical identification code.

6. The thermal printer according to claim 1, further comprising a communication unit that performs communication with an external device, wherein the control unit changes the predetermined number of labels depending on an external instruction input via the communication unit.

7. The thermal printer according to claim 1, wherein the control unit causes the inspection unit to perform the inspection when the thermal head does not perform printing and the feed unit performs feeding of the print medium.

* * * * *